US005355793A

United States Patent [19]

Sato et al.

[11] Patent Number: 5,355,793

[45] Date of Patent: Oct. 18, 1994

[54] METHOD AND APPARATUS FOR MAKING A MIMEOGRAPHIC PRINTING PLATE

[75] Inventors: Masamichi Sato; Kenji Yamakawa, both of Tokyo, Japan

[73] Assignee: Fuji Photo Film Co., Ltd., Kanagawa, Japan

[21] Appl. No.: 933,196

[22] Filed: Aug. 21, 1992

[30] Foreign Application Priority Data

Aug. 21, 1991 [JP] Japan ..... 3-233936

[51] Int. Cl.[5] ..... B41F 15/10; B41L 13/00

[52] U.S. Cl. ..... 101/128.21; 101/129; 101/401.1; 400/120.16; 346/76 PH; 358/298

[58] Field of Search ..... 101/114, 115, 127, 128.21, 101/128.4, 129, 395, 401.1; 358/298; 400/120; 346/76 PH

[56] References Cited

U.S. PATENT DOCUMENTS

| | | | |
|---|---|---|---|
| Re. 28,255 | 11/1974 | Aughton | 354/210 |
| 3,673,954 | 7/1972 | Lala | 101/115 |
| 3,985,953 | 10/1976 | Dunkley | 101/170 X |
| 4,558,328 | 12/1985 | Takanashi et al. | 346/76 PH |
| 4,777,496 | 10/1988 | Maejima et al. | 400/120 |
| 4,779,102 | 10/1988 | Sasaki | 400/120 |
| 4,884,080 | 11/1989 | Hirahara et al. | 400/120 |
| 4,957,378 | 9/1990 | Shima | 101/128.4 |

FOREIGN PATENT DOCUMENTS 73862 4/1985 Japan .

*Primary Examiner*—Edgar S. Burr
*Assistant Examiner*—Stephen R. Funk
*Attorney, Agent, or Firm*—Birch, Stewart, Kolasch & Birch

[57] ABSTRACT

A heat-sensitive material is used for making a mimeographic printing plate. The plate material includes a screen where printing ink is passable, and a resinous membrane formed on its surface. The resinous membrane is heated and melted so as to form a number of minute holes therein for passing the ink therethrough. A thermal head, having a large number of heating elements disposed in a main scan direction, is applied to the plate material. The plate material is moved in a sub scan direction by a predetermined distance, which is a pitch of a plurality of pixels on the plate material. In accordance with the optical density to be reproduced, the time of driving the heating elements is controlled in order to form holes in the pixels, so as to change a length of the hole in the pixels. As a result, the mimeographic plate for printing an image of half-tone can be obtained.

6 Claims, 6 Drawing Sheets

METHOD AND APPARATUS FOR MAKING A MIMEOGRAPHIC PRINTING PLATE

BACKGROUND OF THE INVENTION

Field of the Invention

The present invention relates to a method of making a mimeographic printing plate through which ink can be passed when an image is printed and, more particularly, to a mimeographic plate making method suitable for reproducing the half-tone in printing the image.

Description of the Background Art

There is a method of mimeographic printing for which a mimeographic printing plate is constituted of a support having a number of minute apertures where ink can be passed and a membrane covering the support to be impermeable to the ink. The ink is passed through the minute apertures and the printing areas where the membrane is taken off. Non-image areas on the mimeographic plate are defined by the shape of the remaining membrane on the support. An example of this printing method with such a mimeographic plate is a mimeograph.

There has been proposed a mimeographic printing method with a mimeographic plate, in which the support is a screen of woven fabric or a non-woven fabric having minute apertures, the membrane is a thermoplastic resin formed thereon, and the plate material is heat-sensitive. An original to be reproduced carries an image drawn, or letters written, with a black ink including carbon black. Also, an original to be reproduced may carry a photocopy of an image copied by an electrostatic press copying machine. The original is superimposed on a sheet material prepared for a mimeographic plate. A flash is emanated from a flash lamp and applied to the rear of the plate material. Black portions of the illuminated original image absorb the light to generate heat, which in turn melt and shrink the resinous membrane facing the black portions, so as to form printing areas defined around the unmelted portions of resinous membrane, in correspondence with the black portions of the original image. There is an article commercially available including the same kind of plate material and equipment for making mimeographic plates, called PRINT GOKKO (trade name) manufactured by Riso Kagaku Industries Co., Ltd.

To use this method, the original image must be black and have a sufficiently high optical density. No mimeographic plate can be directly made from an original having a color image. The conventional mimeographic plate making method is also disadvantageous because a flash lamp is used, which is expensive. To make a good mimeographic plate, a flash from the flash lamp is emanated a number of times. Melting the resinous membrane of the plate material requires the generation of a large amount of heat. Illumination of the flash lamp once, however, is insufficient for making a reliable mimeographic printing plate.

There is another mimeographic printing plate making method in which heating of the heat-sensitive plate material is done by a thermal head. An example of this method is conducted by use of an article PRINT GOKKO CD MASTER B6/B5 included in a series of merchandise PRINT GOKKO, and by this method a mimeographic plate can be made by use of a thermal printer of a word processor. This method dispenses with any flash lamp. An image scanner is adapted to be used with the thermal printer and reads even an original color image, which is converted into an electric signal, and the thermal printer is supplied with the electric signal to treat the plate material, which is made into mimeographic plates of three colors, cyan, magenta and yellow. The three mimeographic plates are sequentially applied to full-color or multicolor printing with three-color ink so as to reproduce a color image on paper.

Mimeographic plates as made with a thermal printer reproduce either an image without gradation or a binary value image having only letters and lines. The mimeographic plates, however, cannot reproduce the half-tone of the original image. There is a method of reproducing a pseudo half-tone image taking advantage of the integrating function of human eyes regarding a space, by forming a plurality of dot matrices, and by changing an areal proportion of dots as recorded in the matrices. This is a method of reproducing an areal gradation of a binary value. Examples of this method are a dither pattern method and a dot pattern method.

The binary value areal gradation reproducing method, however, is disadvantageous because it has a considerably low degree of resolving power. Whereas a method of applying $4\times4$ matrices is inferior in a mere 17 step gradation, it has a lower quality from a resolving power $\frac{1}{4}$ as high as the former method. Reproduction of a photographic image should be conducted by use of an areal gradation of at least 32 steps, and preferably an areal gradation of 64 steps or more. However, when the number of steps in the gradation are larger, the resolving power would be lower, or inferior in fineness for a reproduced image.

SUMMARY OF THE INVENTION

In view of the foregoing problems, an object of the present invention is to provide a method of making a plate for mimeographic printing so that the plate is capable of reproducing the half-tone of an original image with high quality.

Another object of the present invention is to provide a mimeographic plate making method so that the plate is capable of reproducing an original image with high resolving power.

A further object of the present invention is to provide a mimeographic plate making method so that the plate is capable of reproducing an original image with less moire.

A still further object of the present invention is to provide a mimeographic plate making method so that the plate is capable of reproducing an original image, with less hue change in printing the image even if a shear of color registration takes place.

In order to achieve the above and other objects and advantages of this invention, a heat-sensitive plate material includes a support through which printing ink is passable, and a thermoplastic resinous membrane formed on a surface thereof. The resinous membrane is heated and melted so as to form holes therein for passing the ink therethrough. A thermal head is applied to the plate material, and the thermal head has a plurality of heating elements disposed in a main scan direction. Relative movement is provided between the thermal head and the plate material in a sub scan direction perpendicular to the main scan direction. The time of driving each of the heating elements is controlled in order to form, in each of regularly arranged rectangular areas (hereinafter termed "pixels") of the plate material (1), a hole. The length of each hole, in the sub scan direction varies in accordance with an optical density to be reproduced by the pixel, thereby to obtain the mimeographic plate for printing an image of half-tone. According to the present method, a mimeographic plate can be made so that the plate is capable of reproducing the half-tone of an original image both with high quality and with high resolving power.

In a preferred embodiment, three mimeographic printing plates are made from the heat-sensitive plate material for reproducing respective color images of cyan, magenta and yellow, thereby to obtain the mimeographic plates for printing a color image of half-tone. There is provided a difference between the cyan reproducing plate and the magenta reproducing plate with respect to the length of the pixels relative to the sub scan direction. Accordingly, an original image can be reproduced with less moire, and with less hue change in printing the image even if a shear of color registration takes place.

Further scope of applicability of the present invention will become apparent from the detailed description given hereinafter. However, it should be understood that the detailed description and specific examples, while indicating preferred embodiments of the invention, are given by way of illustration only, since various changes and modification within the spirit and scope of the invention will become apparent to those skilled in the art from this detailed description.

BRIEF DESCRIPTION OF THE DRAWINGS

The above objects and advantages of the present invention will become more apparent from the following detailed description when read in connection with the accompanying drawings, which are given by way of illustration only, and thus are not limitative of the present invention and in which.

DETAILED DESCRIPTION OF THE PREFERRED EMBODIMENTS OF THE PRESENT INVENTION

Figure 1:
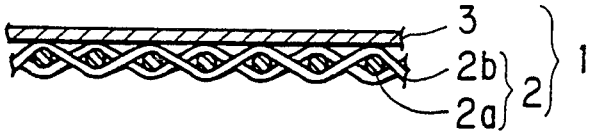
FIG. 1 PRIOR ART
FIG. 1 is a cross section illustrating a prior art plate material to be treated in the mimeographic printing plate making method of an embodiment of the present invention.
Figure 2:
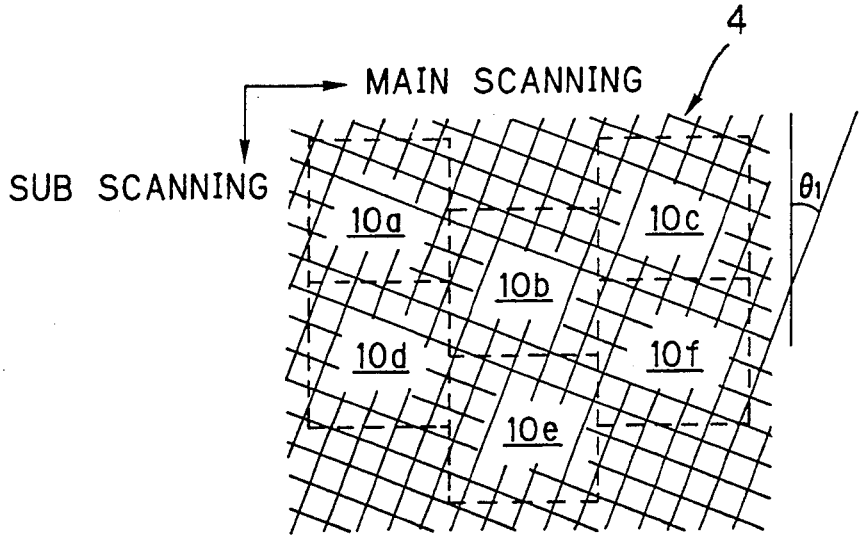
FIG. 2 is a explanatory view illustrating a relationship between pixels and a screen angle of a cyan reproducing plate.
Figure 3:
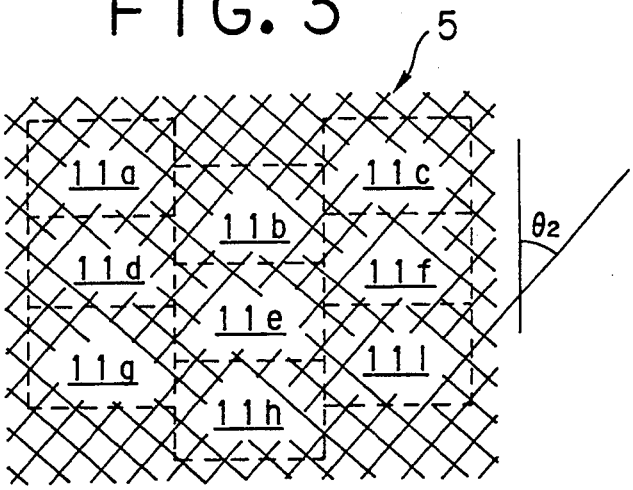
FIG. 3 is a explanatory view illustrating a relationship between pixels and a screen angle of a magenta reproducing plate.
Figure 4:
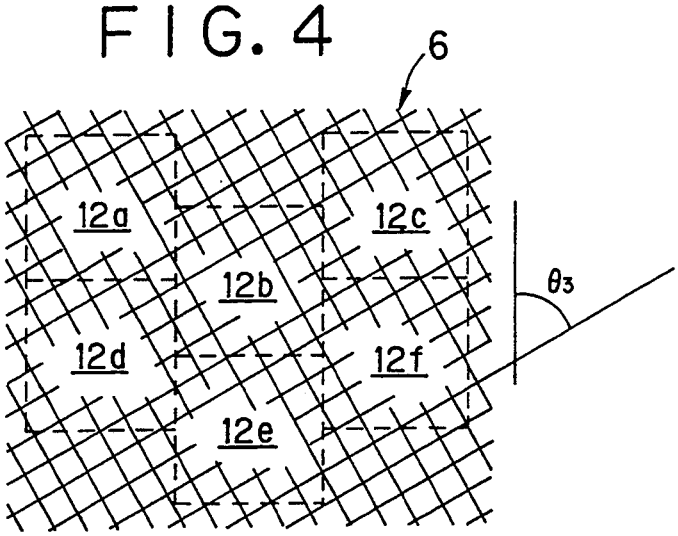
FIG. 4 is a explanatory view illustrating a relationship between pixels and a screen angle of a yellow reproducing plate.

FIG. 1 illustrates a material 1 of a heat-sensitive characteristic for mimeographic printing plates. The plate material has a support constituted of a mesh or a cross-line screen 2, and a thermoplastic resinous membrane 3 having a heat-shrinkable characteristic formed thereon. The screen 2 is woven from weft yarns 2*a* and warp yarns 2*b* of a polyester monofilament. The thermoplastic resinous membrane 3 is made of polystyrene. An example of the plate material 1 is RISOGRAPH RC MASTER 55 (trade name; manufactured by Riso Kagaku Industries Co., Ltd.). The plate material 1 is adapted to making three mimeographic plates 4, 5, and 6 for the three colors cyan, magenta and yellow. Should the incline or screen angle of the woven yarns 2*a* or 2*b* of the screen 2 be equal between the mimeographic plates 4 to 6, moire would be created from interference between the three color images from printing one over another. The angles of the mimeographic plates are determined desirably to be around 45 degrees and to be different from each other. The present embodiment is constructed as illustrated in FIGS. 2 to 4. A screen angle $\theta_1$ of the cyan reproducing plate 4 is 20 degrees. A screen angle $\theta_2$ of the magenta reproducing plate 5 is 40 degrees. A screen angle $\theta_3$ of the yellow reproducing plate 6 is 60 degrees.

The resinous surface of the plate material 1 is separated into regularly arranged rectangular cellular areas, or pixels, defined by relative movement between the plate material and heating elements which will be described later. For the cyan reproducing plate 4 shown in FIG. 2, the pixel pitch relative to a main scan direction and a sub scan direction is set to 8 pixels/mm (that is 100 lines/inch), so that each pixel 10*a* to 10*f* has an area length or pitch of about $125 \times 125$ μm. The pixel 10*a* of an odd number relative to the main scan direction is shifted by half the pitch, in the sub scan direction from the pixel 10*b* of an even number, thereby enlarging the effective pixel pitch with respect to the sub scan direction.

For the magenta reproducing plate 5 shown in FIG. 3, the pixel pitch relative to the main scan direction is 8 pixels/mm (100 lines/inch), the same as that of the cyan reproducing plate 4, but the pixel pitch relative to the sub scan direction is set to 12 pixels/mm (150 lines/inch). Therefore, each pixel 11*a* to 11*i* has an area length of about $125 \times 83$ μm. In order to enlarge the effective pixel pitch with respect to the sub scan direction, adjacent pixels relative to the main scan direction are shifted at half the pitch in position in the sub scan direction.

Each pixel 12*a* to 12*f* on the yellow reproducing plate 6 as shown in FIG. 4 has the pixel pitch of 8 pixels/mm (100 lines/inch) in the main and sub scan direction, which is the same as the case of the cyan reproducing plate 4, and is shifted by half the pitch in position.

A difference in the pixel pitches between cyan and magenta effectively prevents color moire and a hue change as would be caused by a shear of color registration. The hue change can be avoided by setting the difference in the pixel pitch to at least about 2 pixels/mm (25 lines/inch). However, with the pixel pitch difference of 2 pixels/mm, color moire would be created. This color moire can be eliminated by setting the difference between pixel pitches to a value about 4 pixels/mm (50 lines/inch) or larger.

The picture pattern moire can be effectively avoided by shifting the positions of pixels of an odd number of about 20 to 80% from those of an even number. A shift of pixels by half the pitch is particularly effective for preventing the picture pattern moire. It has been recognized that the hue change and color moire are similarly prevented if the pixel pitches of cyan and magenta are reversed, and that the pixel pitch of yellow has a comparatively little effect relative to the occurrence of hue change and color moire.

Figure 8:
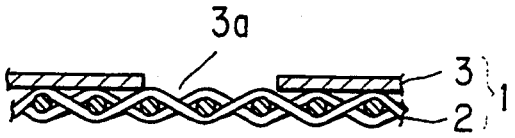
FIG. 8 is a cross section illustrating a state in which part of resinous membrane is heated and melted.
Figure 5:
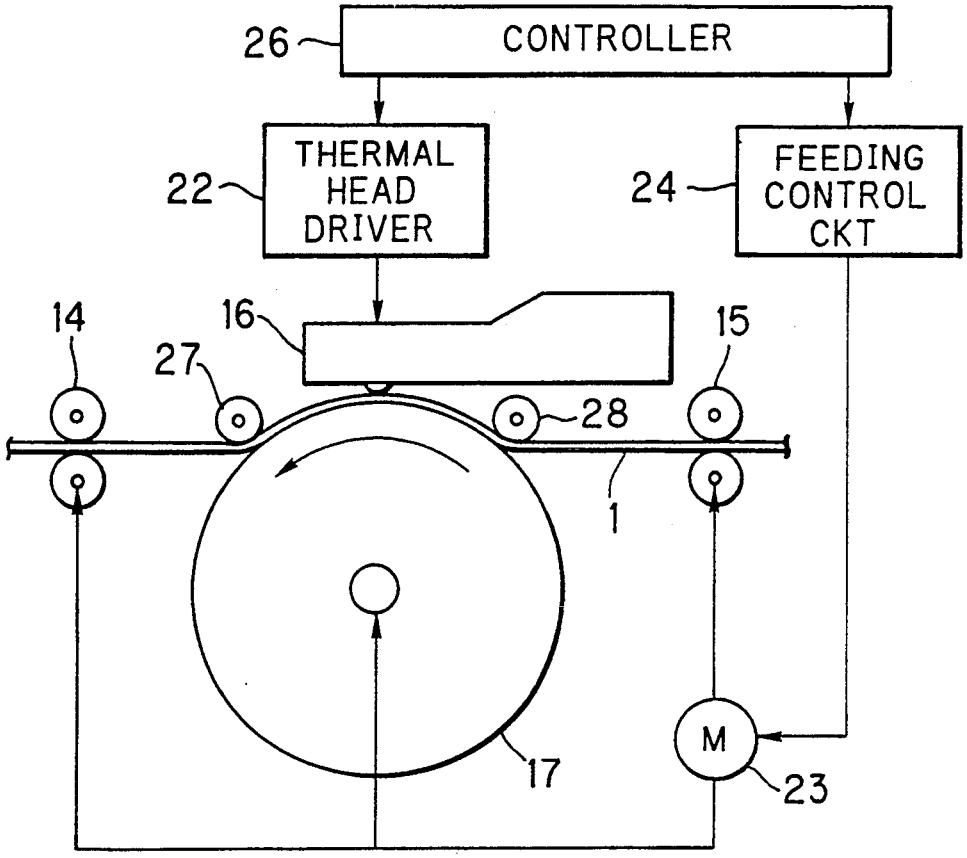
FIG. 5 is a schematic view illustrating an apparatus for making mimeographic plates, for use according to an embodiment of the present method.
Figure 6:
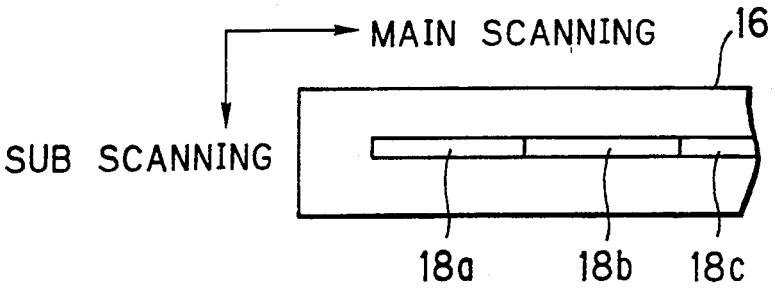
FIG. 6 is a bottom view illustrating a thermal head.

An apparatus practicing an embodiment of the present method will be described next with reference to FIGS. 5 to 7. The plate material 1, as illustrated in FIG. 5, is sheeting clamped between two pairs of feeding rollers 14 and 15, which transport and set the plate material 1 to the position for the melting treatment. The plate material 1 as set in the melting position for forming a hole (to be described later) is squeezed between a thermal head 16 and a platen drum 17, where the resinous membrane 3 is melted and shrunk in accordance with the image optical density for the plate to be reproduced. The thermal head 16 has a great number of heating elements in alignment in the main scan direction, of which only three heating elements 18*a* to 18*c* are illustrated in FIG. 6. A thermal head driver 22 controls the power supply time of each heating element of the thermal head 16 while the plate material 1 is moved in the sub scan direction by a distance corresponding to one pixel, to thereby determine the length for melting the resinous membrane 3 relative to the sub scan direction in accordance with the optical density to be reproduced. The resinous membrane 3 is melted to form a hole 3*a* (see FIG. 8), which becomes a part of the printing area on a mimeographic plates and is adapted for passing the printing ink therethrough.

A motor 23 controls and rotates the feeding rollers 14 and 15 and the platen drum 17 in accordance with a drive signal from a feeding control circuit 24. A controller 26 sequentially controls the head driver 22 and the feeding control circuit 24. Reference numerals 27 and 28 designate rollers for fitting the plate material 1 on to the platen drum 17. It is noted that blotting paper preferably can be wound around the platen drum 17 under the plate material 1 for receiving the resinous membrane 3 as melted to prevent dirt from forming on the platen drum 17.

Figure 7:
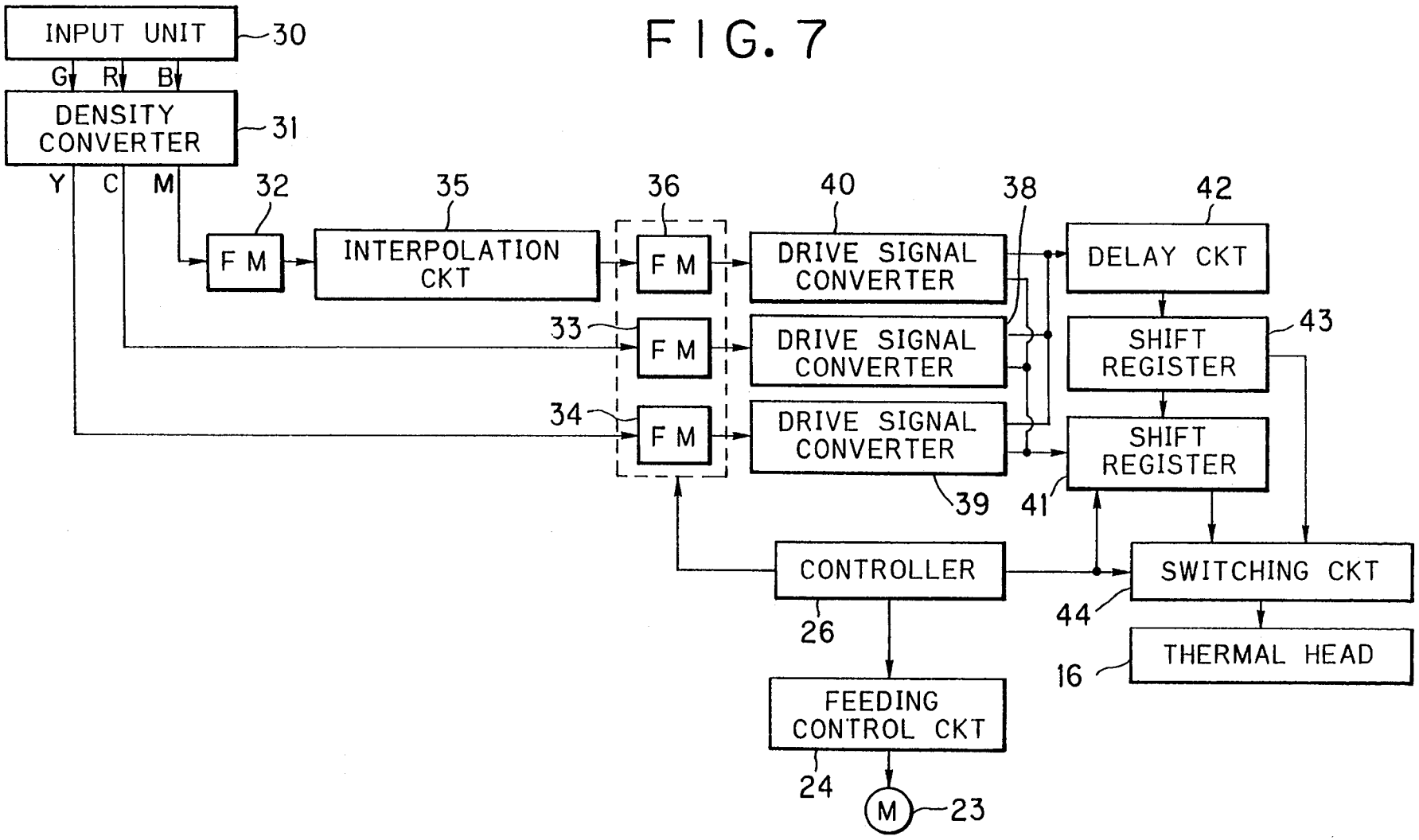
FIG. 7 is a block diagram illustrating a head driver.

FIG. 7 shows an example of the head driver 22. An input unit 30 is constructed of a video tape recorder, an image scanner, or the like. The input unit 30 sends a green video signal G, a red video signal R, and a blue video signal B of an image of an original to a density converter 31, which converts the three-color video signals into a magenta image signal M, a cyan image signal C, and a yellow image signal Y which are then written in frame memories 32 to 34, respectively.

In this embodiment, in order to avoid hue change as caused by a shear of color registration, an interpolation circuit 35 is connected to the frame memory 32. The interpolation circuit 35 interpolates the magenta density signal, as read from the frame memory 32, by adding one picture element to N picture elements. The signal of the interpolated picture element is written into a frame memory 36. For example, with an interpolation by 50%, one picture element is added to two picture elements arranged in the sub scan direction. An average value of the density signal of the two picture elements is used as the density signal of the added picture element.

In an operation of making the mimeographic plates 4 to 6, a controller 26 sequentially sets a reading mode to the three frame memories 33 to 36 according to the mimeographic plate 4, 5 or 6. A signal of a stored image density to be reproduced of one line of picture elements is sequentially read out from the frame memory set in the reading mode, and sent to the corresponding one of three drive signal converters 38 to 40 where they are converted into drive signals, each having a certain number of bits corresponding to the steps of the areal gradation of a picture element of the image of interest. A drive signal of a picture element of an odd number in the main scan direction among drive signals of one line of picture elements is sent to a shift register 41, whereas a drive signal of a picture element of an even number is delayed by a delay circuit 42 and sent to a shift register 43. With the delay circuit 42, melting positions in one line of picture elements are not disposed linearly, but are shifted by half the pitch at every second pixel in the sub scan direction.

If an areal gradation having 32 steps is used, the drive signal is assigned 32 bits per one picture element. Drive signals of picture elements are read 32 times divisionally. Specifically, at the start of treating one line of picture elements, only the first bits of respective picture elements of the drive signals are sequentially read and sent as serial signals to the shift registers 41 and 43 where they are converted into parallel signals. In this manner, bits of each digit are sequentially read at a constant time interval and sent to the shift registers 41 and 43. A switching circuit 44 includes a number of latch circuits and switches corresponding to the number of heating elements of the thermal head 16. Signals loaded in the shift registers 41 and 43 are latched in the latch circuits at predetermined time points If the latch circuit takes a value "1" the corresponding switch turns ON, whereas if the latch circuit takes a value "0" the switch turns OFF When the switch turns ON, the heating element connected to the switch is powered to heat the resinous membrane 3 on the plate material 1.

The feeding control circuit 24 causes the motor 23 to rotate in synchronism with the drive signal to the thermal head 16 and at the speed corresponding to the pixel pitch in the sub scan direction. In one example of the present embodiment, the pixel pitch for the magenta reproducing plate 5 is shorter than the pitches on the mimeographic plates 4 and 6 for the other two colors, so that the motor 23 is rotated at a slower speed.

The operation of the embodied apparatus will be described next, with reference to FIGS. 8 to 14. A video signal inputted from the input unit 30 is converted into a density signal and written into the frame memories 32, 33 and 34. The yellow signal written into the frame memory 32 is subjected to an interpolation processing in relation to the sub scan direction at the interpolation circuit 35, and thereafter written into the frame memory 36.

When the cyan reproducing plate 4 is made, the plate material 1 at the screen angle $\theta_1$ of 20 degrees is set in a holder of the mimeographic plate-making apparatus. A manual operation of a keyboard commands the controller 26 to make a mimeographic plate 4. The motor 23 is driven to rotate the feed rollers 14 and 15 and the platen drum 17. The leading end of the plate material 1 is set in the position for the melting treatment. The controller 26 sets the frame memory 33 to a reading mode next, to read the cyan density signal of one line. The cyan density signal of one line as read out is converted into drive signals of 33 bits at the drive signal converter 38, which drive signals are separated into drive signals of odd numbers and even numbers with respect to the main scan direction. The drive signals of picture elements of odd numbers are converted into serial signals by aggregating bits of the same digits, and sent to the shift register 41. The drive signals of picture elements of even numbers are converted into serial signals, delayed by half the pitch by the delay circuit 42, and sent to the shift register 43. The shift registers 41 and 43 convert the serial signals into parallel signals which are sent to the switching circuit 44. The switching circuit 44 turns ON the heating elements of the thermal head 16.

The plate material 1 is continuously transported in the sub scan direction. While the plate material 1 is moved by the distance corresponding to the length of one pixel in the sub scan direction, each heating element is powered for a period determined by the drive signal. In this case, the heating elements for the even number pixels are powered at the time points delayed by the delay circuit 42 at half the pitch.

When the drive signal is supplied to each heating element of the thermal head 16, the resinous membrane 3 of the plate material 1 is heated and melted according to the drive time, thereby forming the hole 3*a* in the plate material 1 and this area is adapted for passing cyan ink therethrough and thus becomes part of the cyan printing area on the mimeographic plate 4. A cyan density signal of a second line is read from the frame memory 33 next, so as to form holes in a second line of pixels on the plate material 1 in a like manner. Upon the completion of forming holes on the plate material 1 for the cyan ink of one frame, the cyan reproducing plate 4 is obtained.

To make the magenta reproducing plate 5, the plate material 1 is set at the screen angle $\theta_2$ of 40 degrees. While holes for magenta are formed on the plate material 1, the feeding control circuit 24 causes the motor 23 to rotate at a slower speed to provide the pixel with a slower feed speed in the sub scan direction, because the magenta pixel pitch is set to 12 pixels/mm (150 lines-/inch) in an example of the present embodiment. If the speed of melting the resinous membrane 3 is made faster, the feed speed of the plate material 1 does not need to be changed.

In the above embodiment, a relative movement in the sub scan direction between the heating element and the plate material 1 is continuous. The heating elements are driven during the drive time, each time that the plate material is moved a predetermined distance. This relative movement may be intermittent. By feeding the plate material 1 a number of times in an intermittent movement, drive pulses are controlled in synchronism with the movement to change the length of melting the resinous membrane 3 in a pixel.

Figure 9:
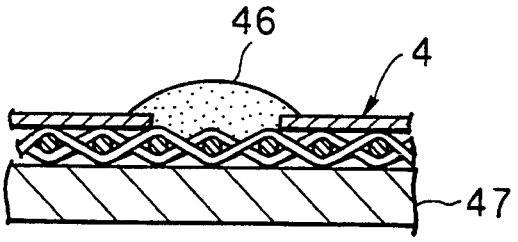
FIG. 9 is a cross section illustrating a state in which cyan ink is applied to the .mimeographic plate superposed on printing paper.
Figure 10:
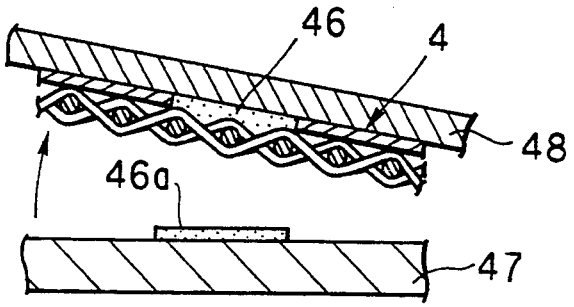
FIG. 10 is a cross section illustrating a state in which the mimeographic plate is peeled off from the printing paper.

An operation of mimeographic printing of three-color images one over another is conducted by use of the mimeographic plates 4 to 6 as prepared above. As illustrated in FIG. 9, cyan ink 46 is applied to the face of the resinous membrane 3 of the mimeographic plate 4, of which the face of the screen 2 is superposed on printing paper 47. A pressure member 48 is lapped on the cyan reproducing plate 4. When pressure is applied to the top of the pressure member 48, the cyan ink 46 is passed through the mimeographic plate 4 to the printing paper 47 via the hole 3*a* and screen apertures of the screen 2. Then the mimeographic plate 4 with the pressure member 48 is peeled away from the printing paper 47, upon which a cyan ink dot 46*a* remains stuck on the surface of printing paper 47 having a shape and length corresponding to the hole 3*a*, and a cyan image is thereby reproduced. Then a magenta image is printed with the magenta reproducing plate 5 and magenta ink on the printing paper 47, on which a yellow image is at last printed with the yellow reproducing plate 6 and yellow ink.

Figure 11:
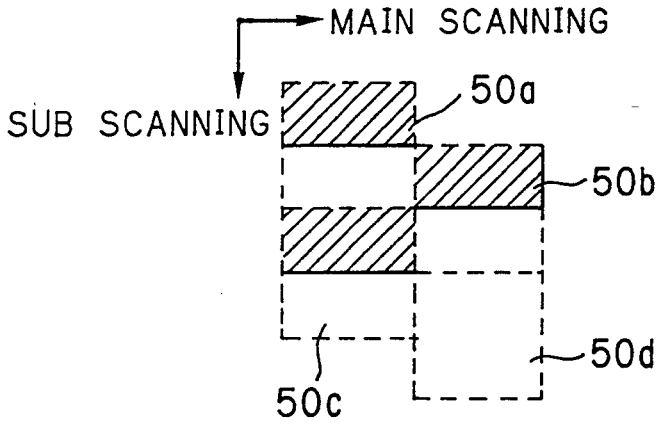
FIG. 11 is an explanatory view illustrating yellow dots constituting a yellow image.
Figure 12:
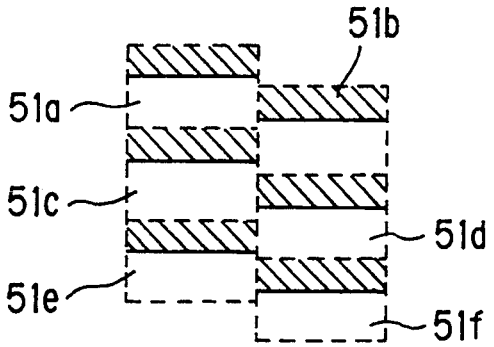
FIG. 12 is an explanatory view illustrating magenta dots constituting a magenta image.
Figure 13:
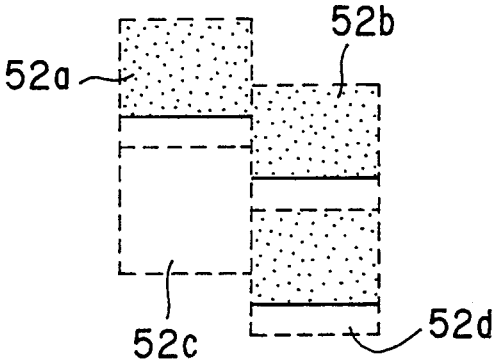
FIG. 13 is an explanatory view illustrating cyan dots constituting a cyan image.
Figure 14:
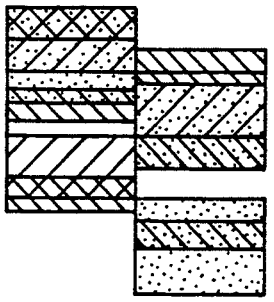
FIG. 14 is an explanatory view illustrating a multicolor image as reproduced on the printing paper.

FIG. 11 illustrates pixels 50*a* to 50*d* on the printing paper 47 and the yellow image as printed, which is constituted of rectangular yellow ink dots indicated by the hatching in the pixels 50*a* to 50*c* indicated by the broken lines. The magenta image is constituted of magenta ink dots indicated by the hatching in FIG. 12, in portions of pixels 51*a* to 51*f*. The cyan image is constituted of cyan ink dots indicated by the hatching in FIG. 13, in portions of pixels 52*a* to 52*d*. The ink dots of these three colors are superimposed as illustrated in FIG. 14 to reproduce a multicolor image of half-tone. The mimeographic printing herein can be performed with a three-color set of RISO INK FOR FULL COLOR and a printing machine PRINT GOKKO PG-10 (both trade names; manufactured by Riso Kagaku Industries Co., Ltd.), by use of which postcards, for example, can be printed in full color.

Figure 15:
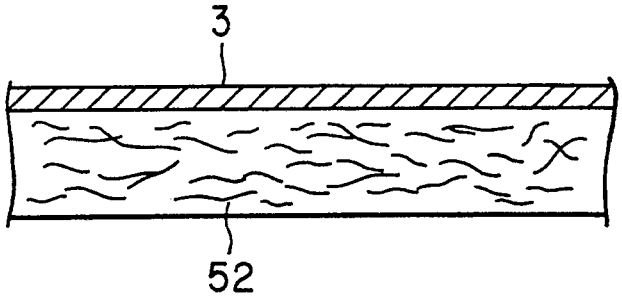
FIG. 15 is a cross section illustrating another example of the plate material.

The screen 2 supporting the plate material 1 is woven from polyester monofilament in one embodiment of the present invention. However, the screen 2 may be woven from other fiber of either monofilament or multifilament, in the regular manner of a screen fabric. Examples of other fibers are: natural fibers such as paper mulberry, edgewortia papyrifera, Manila hemp, and flax; synthetic fibers such as rayon and vinylon; and mixtures thereof, Instead of the screen 2, a support 52 of paper may be used, e.g. Japanese paper as illustrated in FIG. 15, constituted of complex entanglement of short fibers of material like the examples as referred to above. The mimeographic plates made from the paper plate material may be used for printing according to mimeograph.

The resinous membrane 3 is polystyrene, but alternatively may be of vinylidene chloride-vinyl chloride copolymer, propylene-ethylene copolymer, vinyl acetate-ethylene copolymer, polypropylene, polyvinyl chloride, and so on. The thickness of resinous membrane 3 is desirably in the range from several $\mu$m to several tens of $\mu$m, and more preferably from 3 to 10 $\mu$m, approximately.

The above embodiments use a linear type of mimeographic plate making apparatus where the plate material 1 and the thermal head 16 are relatively moved one-dimensionally in the sub-scan direction. The present invention is also applicable to a serial type of mimeographic plate making apparatus having a two-dimensional relative movement. In this case, a thermal head is used whose heating elements are disposed linearly in the main scan direction, i.e., the transporting direction of the plate material 1. The thermal head is moved in the sub scan direction, to which the plate material is transported perpendicularly.

Although the present invention has been fully described by way of the preferred embodiments thereof with reference to the accompanying drawings, various changes and modifications will be apparent to those having skill in this field. Therefore, unless these changes and modifications depart from the scope of the present invention, they should be construed as included therein.

What is claimed is:

1. A method of making a plurality of mimeographic printing plates from a heat sensitive plate material including a support through which printing ink is passable and a thermoplastic resinous membrane formed on a surface thereof, said thermoplastic resinous membrane being heated and melted so as to form holes therein for passing said printing ink therethrough, said method comprising the steps of:

(a) applying a thermal head to said plate material, said thermal head having a plurality of heating elements disposed in a main scan direction, each element of which is repeatedly energized and de-energized during the making of said mimeographic plate;

(b) providing relative movement between said thermal head and said plate material in a sub scan direction perpendicular to said main scan direction, the amount of relative movement during a time interval between the commencement of successive energizings of a given heating element, during the makeup of said mimeographic plate, defines pixel length and the width of each heating element defines pixel width, to thereby define pixels on said plate material, wherein said heating elements have a length relative to said sub scan direction which is much smaller than said length of said pixels relative to said sub scan direction; and (c) controlling the time of driving each of said heating elements in order to form a hole in each pixel of said plate material during the relative movement between said thermal head and said plate material provided in step (b), the length of each hole within each pixel varying in accordance with an optical density to be reproduced by said pixel so that a mimeographic printing plate for printing a half tone image is obtained;

(d) repeating steps (a) to (c) so as to produce three mimeographic plates corresponding to the colors cyan, magenta, and yellow, said mimeographic plates being used to print a multicolor image, wherein repeating said steps (a) to (c) for the cyan and magenta mimeographic plates includes;

varying said length of said pixels relative to said sub scan direction for the cyan plate with respect to the magenta plate such that the length of said pixels in the cyan plate are different than the length of said pixels in the magenta plate.

2. A method of making mimeographic printing plates from a heat-sensitive plate material including a support through which printing ink is passable and a thermoplastic resinous membrane formed on a surface thereof, said thermoplastic resinous membrane being heated and melted so as to form holes therein for passing said printing ink therethrough, said method comprising the steps of:

(a) applying a thermal head to said plate material, said thermal head having a plurality of heating elements disposed in a main scan direction, each element of which is repeatedly energized and de-energized during the making of said mimeographic plate;

(b) providing relative movement between said thermal head and said plate material in a sub scan direction perpendicular to said main scan direction, the amount of relative movement during a time interval between the commencement of successive energizings of a given heating element, during the making of said mimeographic plate, defines pixel length and the width of each heating element defines pixel width, to thereby define pixels on said plate material, wherein said heating elements have a length relative to said sub scan direction which is much smaller than said length of said pixels relative to said sub scan direction; and (c) controlling the time of driving each of said heating elements in order to form a hole in each pixel of said plate material, wherein the length of each hole varies in accordance with an optical density to be reproduced by said pixel.

(d) repeating steps (a) to (c) so as to produce three mimeograpic plates corresponding to optical densities for the colors cyan, magenta, and yellow, respectfully, said mimeographic plates being used to print a multicolor image, wherein repeating said steps (a) to (c) for the cyan and magenta mimeographic plates includes;

varying said length of said pixels relative to said sub scan direction for the cyan plate with respect to the magenta plate such that the length of said pixels in the cyan plate are different than the length of said pixels in the magenta plate.

3. The method of making three mimeographic printing plates as defined in claim 2, wherein positions of said pixels adjacent in said main scan direction on the cyan mimeographic printing plate and the magenta mimeographic printing plate are shifted by predetermined distances in said sub scan direction.

4. The method of making three mimeographic printing plates as defined in claim 3, wherein said predetermined distances are half as long as the lengths of said pixels relative to said sub scan direction.

5. The method of making three mimeographic printing plates as defined in claim 2, wherein said support includes a screen, and wherein the screen angle between said sub scan direction and warp yarns woven into said screen are different for the cyan mimeographic printing plate versus the magenta mimeographic printing plate.

6. A method of making half-tone mimeographic printing plates, from heat sensitive plate material, for respectively reproducing images of first, second and third colors, the heat sensitive plate material having a support through which ink is passable and a thermoplastic resinous material formed on a surface of the support, said method comprising the steps of:

a) heating the thermoplastic resinous material with a thermal head having a plurality of hating elements in a main scan direction to melt holes therethrough, wherein each element is repeatedly energized and de-energized during the making of a plate for reproducing a given one of said colors; and b) feeding the plate material across the thermal head in a sub scan direction perpendicular to the main scan direction to provide relative movement between the plate material and the thermal head, the amount of relative movement during the time interval between the commencement of successive energizings of a given heating element during the make-up of said plate defining pixel length and the width of each heating element defining pixel width, to thereby define pixels on said plate material, controlling said step (a) of heating the thermoplastic resinous material and said step (b) of feeding the plate material to form holes in the thermoplastic resinous material through which ink may pass, the formed holes having a length in the sub scan direction which varies in accordance with an optical density to be reproduced by the corresponding pixel and which is smaller than the length in the sub scan direction of said pixel;

the first, second and third colors respectively comprise cyan, magenta and yellow;

the pixel length in a first of the half-tone mimeographic printing plates for reproducing cyan images being formed to be larger than the pixel length in a second of the half-tone mimeographic printing plates for reproducing magenta images.

* * * * *